US009182123B2

(12) United States Patent
Boardman et al.

(10) Patent No.: US 9,182,123 B2
(45) Date of Patent: Nov. 10, 2015

(54) COMBUSTOR FUEL NOZZLE AND METHOD FOR SUPPLYING FUEL TO A COMBUSTOR

(75) Inventors: Gregory Allen Boardman, Greer, SC (US); Ronald James Chila, Greenfield Center, NY (US); Johnie F. McConnaughhay, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 981 days.

(21) Appl. No.: 13/344,033

(22) Filed: Jan. 5, 2012

(65) Prior Publication Data

US 2013/0174563 A1 Jul. 11, 2013

(51) Int. Cl.
*F23R 3/14* (2006.01)
*F23R 3/28* (2006.01)

(52) U.S. Cl.
CPC .. *F23R 3/14* (2013.01); *F23R 3/286* (2013.01)

(58) Field of Classification Search
CPC ..... F23R 3/286; F23R 3/14; F23R 3/34; F23R 3/36; F23R 3/28; F23R 3/42
See application file for complete search history.

(56) References Cited

U.S. PATENT DOCUMENTS 5,251,447 A 10/1993 Joshi et al.
5,351,477 A 10/1994 Joshi et al.
5,816,049 A 10/1998 Joshi
5,862,668 A * 1/1999 Richardson ..... 60/737
6,272,840 B1 8/2001 Crocker et al.
6,367,262 B1 4/2002 Mongia et al.
7,434,401 B2 * 10/2008 Hayashi ..... 60/743
8,347,630 B2 * 1/2013 Lovett et al. ..... 60/737
2006/0021350 A1 * 2/2006 Sanders ..... 60/743
2008/0083229 A1 * 4/2008 Haynes et al. ..... 60/776
2011/0289933 A1 * 12/2011 Boardman et al. ..... 60/776

* cited by examiner

*Primary Examiner* — Phutthiwat Wongwian
*Assistant Examiner* — Carlos A Rivera
(74) *Attorney, Agent, or Firm* — Dority & Manning, PA

(57) ABSTRACT

A combustor fuel nozzle includes a center body and an inner shroud that circumferentially surrounds at least a portion of the center body. The inner shroud has a downstream surface. The fuel nozzle includes an inner passage between the center body and the inner shroud, an outer passage that circumferentially surrounds at least a portion of the inner shroud and a first plurality of fuel ports extending substantially radially outward through the center body. The first plurality of fuel ports is upstream from the downstream surface of the inner shroud. A method for supplying fuel to a combustor fuel nozzle includes flowing a working fluid through an inner passage between a center body and an inner shroud, injecting a fuel from the center body against the inner shroud, and flowing a portion of the working fluid through an outer passage that surrounds at least a portion of the inner shroud.

18 Claims, 7 Drawing Sheets

COMBUSTOR FUEL NOZZLE AND METHOD FOR SUPPLYING FUEL TO A COMBUSTOR

FIELD OF THE INVENTION

The present invention generally involves a combustor fuel nozzle and a method for supplying fuel to a combustor.

BACKGROUND OF THE INVENTION

Gas turbines are widely used in commercial operations for power generation. Gas turbine combustors generally operate on a liquid and/or a gaseous fuel mixed with a compressed working fluid such as air. The flexibility to run a gas turbine on either fuel provides a great benefit to gas turbine operators.

It is widely known that the thermodynamic efficiency of a gas turbine increases as the operating temperature, namely the combustion gas temperature, increases. It is also known that higher combustion gas temperatures may be attained by providing a rich fuel/air mixture in the combustion zone of a combustor. However, higher combustion temperatures resulting from a rich liquid or gaseous fuel/air mixture significantly increase the generation of nitrogen oxide or NOx, which is an undesirable exhaust emission. NOx levels may be reduced by providing a lean fuel/air ratio for combustion or by injecting additives, such as water, into the combustor.

To provide a lean fuel/air mixture the fuel and air may be premixed prior to combustion. The premixing may take place in a dual-fuel combustor fuel nozzle, which includes multiple fuel injection ports, an inner flow region and an outer flow region. As the gas turbine cycles through various operating modes, fuel is injected into the inner and/or outer flow regions for premixing with the working fluid. A variety of dual-fuel nozzles exist which allow premixing of a liquid and/or gaseous fuel with a working fluid prior to combustion. However, an improved fuel nozzle and method for supplying fuel to a combustor that improves the uniformity of the fuel mixture would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor fuel nozzle including a center body and an inner shroud that circumferentially surrounds at least a portion of the center body, wherein the inner shroud has a downstream surface. An inner annular passage between the center body and the inner shroud and an outer annular passage that circumferentially surrounds at least a portion of the inner shroud and a first plurality of fuel ports that extend substantially radially outward through the center body. The first plurality of fuel ports is upstream from the downstream surface of the inner shroud.

Another embodiment of the present invention is a combustor fuel nozzle that includes a center body and an inner shroud that circumferentially surrounds at least a portion of the center body, wherein the inner shroud has a downstream surface, an inner annular passage between the center body and the inner shroud and an outer annular passage that circumferentially surrounds at least a portion of the inner shroud. A first plurality of fuel ports extends substantially radially outward through the center body, wherein the first plurality of fuel ports is upstream from the downstream surface of the inner shroud, and a second plurality of fuel ports that extend radially inward from the inner shroud.

The present invention also includes a method for supplying fuel to a combustor fuel nozzle that includes flowing a working fluid through an inner annular passage between a center body and an inner shroud and injecting a first fuel from the center body against the inner shroud. The method further includes flowing at least a portion of the working fluid through an outer annular passage that circumferentially surrounds at least a portion of the inner shroud.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
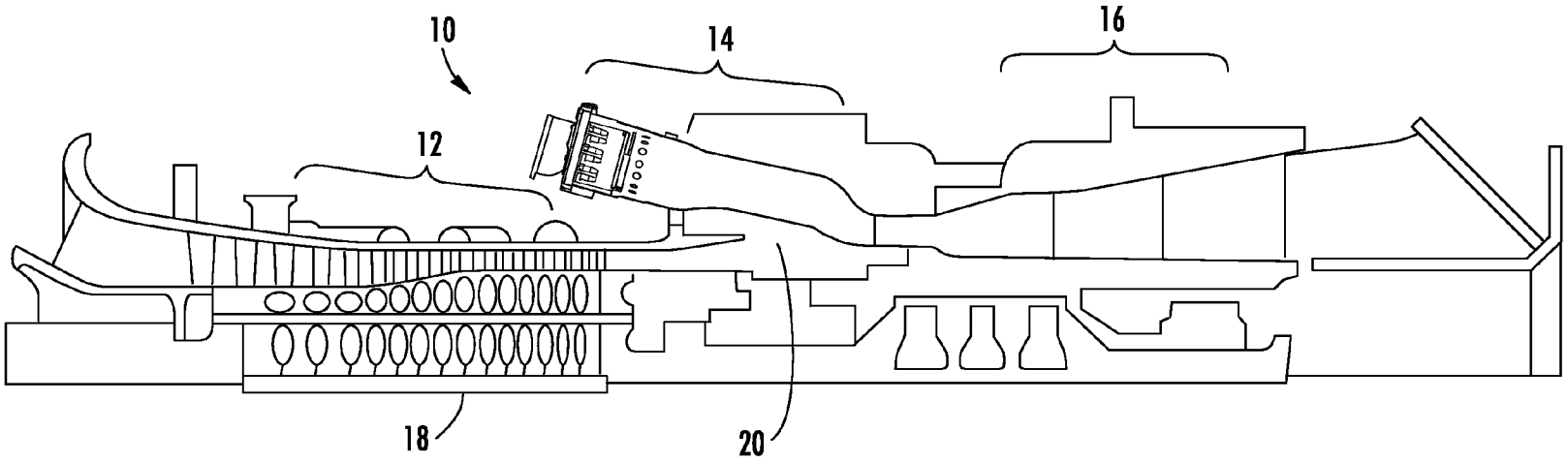
FIG. 1 is a simplified cross-section an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations as come within the scope of the appended claims and their equivalents.

Various embodiments of the present invention include a combustor fuel nozzle and method for providing fuel to a combustor. The fuel nozzle generally includes a center body, an inner shroud with a downstream surface, an inner annular passage and an outer annular passage. A working fluid may flow through the center body, the inner annular passage and/or the outer annular passage. A first plurality of fuel ports, positioned upstream from the downstream surface of the inner shroud, extend generally radially outward through the center body. In this manner, as the working fluid passes through the inner annular passage and a liquid fuel is injected through the first plurality of fuel ports, a portion of the fuel may vaporize and mix with the working fluid. The remainder of the liquid fuel will pre-film on the inner shroud and shear off the downstream surface, thus providing a fine spray of the remaining liquid fuel for further mixing with the working fluid for combustion.

Although exemplary embodiments of the present invention will be described generally in the context of a combustor fuel nozzle incorporated into a gas turbine, for purposes of illustration, one of ordinary skill in the art will readily appreciate that embodiments of the present invention may be applied to any fuel nozzle and are not limited to a gas turbine fuel nozzle unless specifically recited in the claims.

FIG. 1 shows a typical gas turbine 10 within the scope of the present invention. The gas turbine 10 includes a compressor 12 at the front, one or more combustors 14 around the middle, and a turbine 16 at the rear. The compressor 12 and the turbine 16 typically share a common rotor 18. The compressor 12 imparts kinetic energy to the working fluid (air) to bring it to a highly energized state. The compressed working fluid exits the compressor 12 and flows to each combustor 14.

Figure 2:
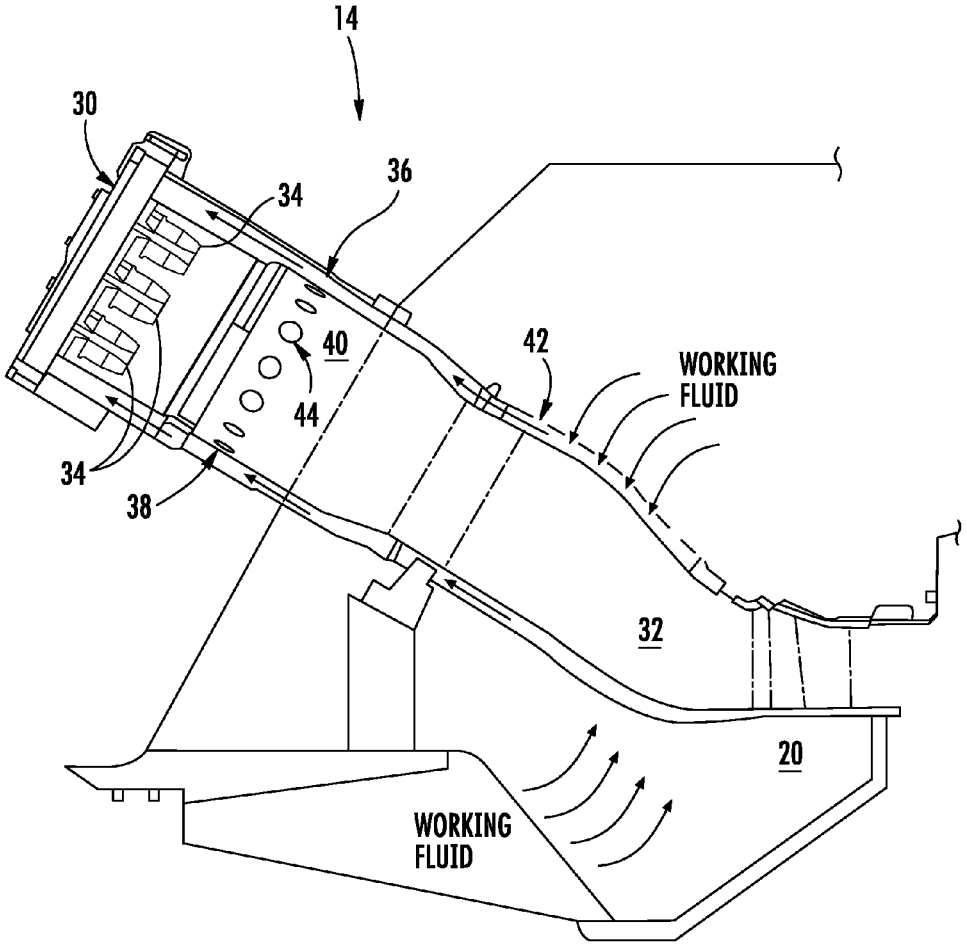
FIG. 2 is a simplified cross-section of the combustor shown in FIG. 1.

Referring to FIG. 2, each combustor 14 includes an end cover assembly 30 at one end and a transition piece 32 at the other end. The end cover assembly 30 includes one or more fuel nozzles 34. A casing 36 surrounds each combustor 14 to contain the compressed working fluid flowing from the compressor 12. A liner 38 inside the casing 36 peripherally surrounds a portion of each combustor 14 to define a combustion chamber 40 in each combustor 14. The compressed working fluid enters through dilution passages 42, and travels along the outside of the liner 38 (as shown by the arrows) to cool the liner 38. A portion of the compressed working fluid enters the combustion chamber 40 through mixing holes 44, and the remainder of the compressed working fluid reverses direction at the end cover 30 and enters the combustion chamber through one or more fuel nozzles 34.

Figure 3:
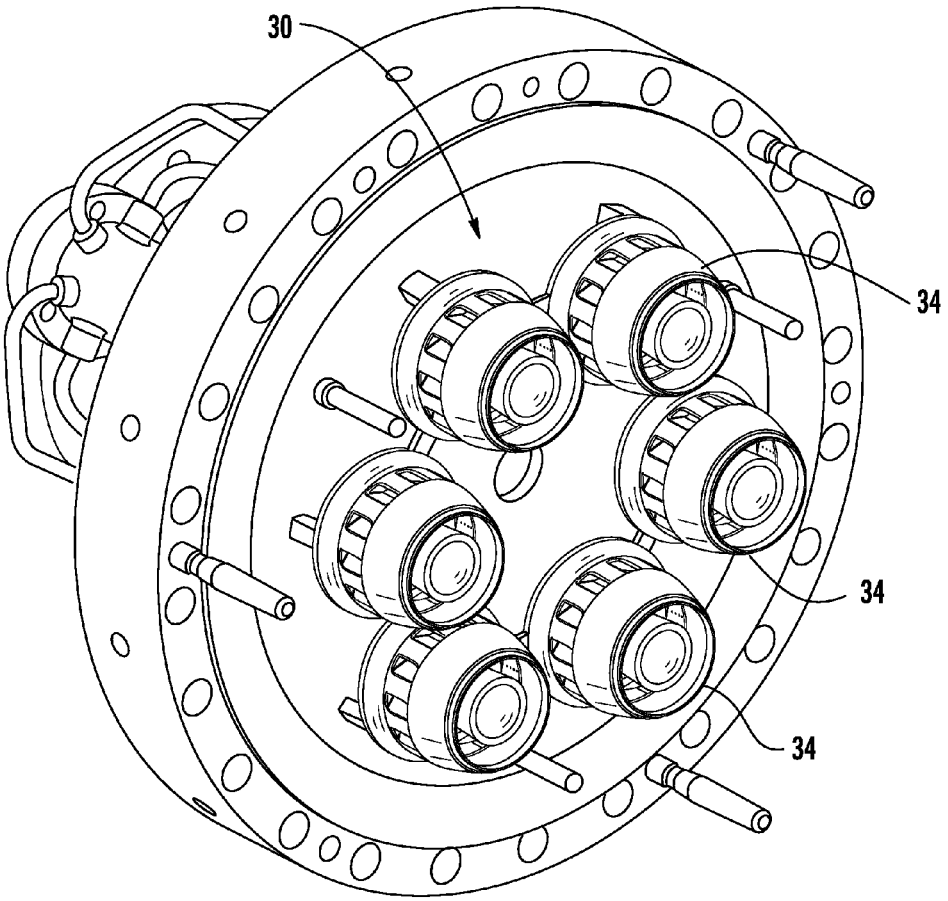
FIG. 3 is a perspective view of the nozzle assembly shown in FIG. 2.

FIG. 3 provides a perspective view of the end cover assembly 30 shown in FIG. 2. Each fuel nozzle 34 mixes fuel with the compressed working fluid. The mixture of fuel and working fluid ignites in the combustion chamber 40, as shown in FIG. 2, to generate combustion gases having a high temperature, pressure, and velocity. The combustion gases flow through the transition piece 32 to the turbine 16 where they expand to produce work.

Figure 4:
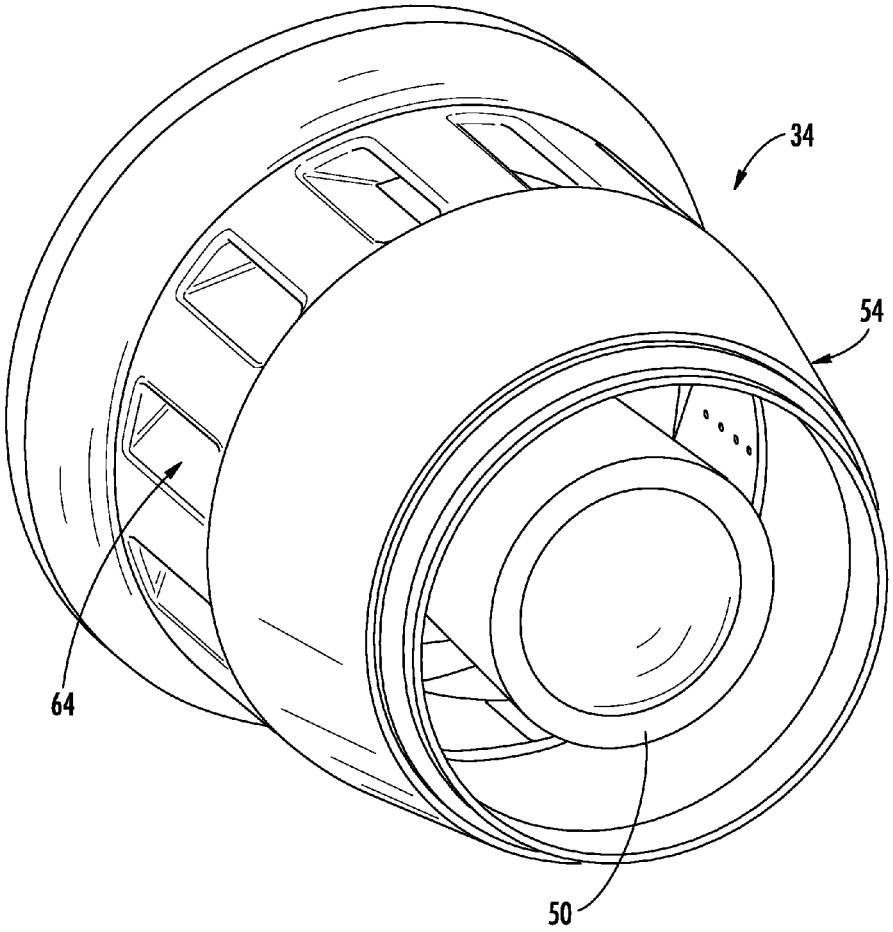
FIG. 4 is a perspective view of a nozzle according to one embodiment of the present invention.
Figure 5:
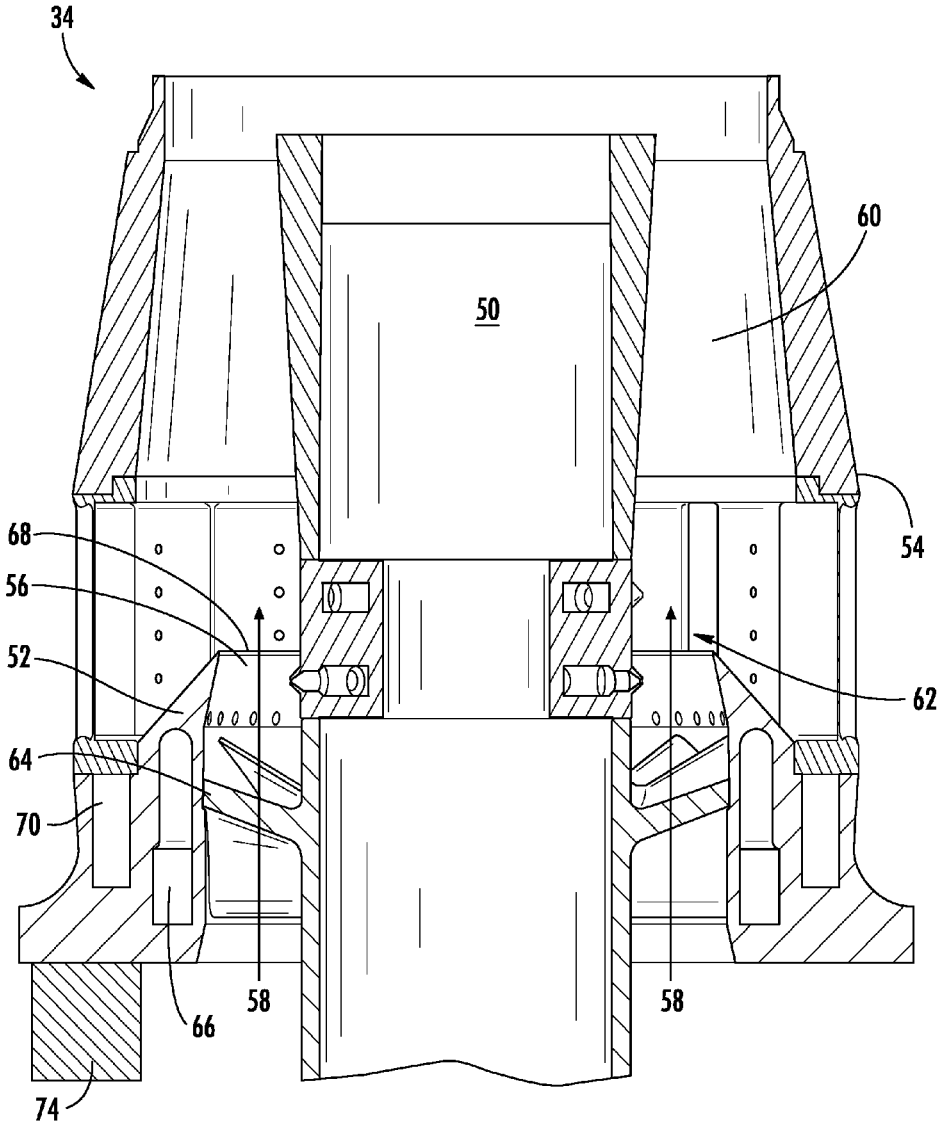
FIG. 5 is a cross-section view of the nozzle shown in FIG. 4.

FIG. 4 provides a perspective view of a fuel nozzle 34 according to one embodiment of the present invention, and FIG. 5 provides a cross-section view of the fuel nozzle 34 shown in FIG. 4. As shown in FIGS. 4 and 5, the fuel nozzle 34 generally includes a center body 50, an inner shroud 52 as shown in FIG. 5, and an outer shroud 54. The center body 50 and inner shroud 52 define an inner annular passage 56 between the center body 50 and the inner shroud 52, and the inner annular passage provides an axial flow region 58. The inner shroud 52 and outer shroud 54 define an outer annular passage 60 that circumferentially surrounds at least a portion of the inner shroud 52 and provides a radial flow region 62.

As shown in FIG. 5, the center body 50 may provide fluid communication through the fuel nozzle 34 and into the combustion chamber 40. The center body 50 may be configured to flow the working fluid, a liquid and/or a gaseous fuel. The nozzle 34 may include a plurality of vanes 64 that extend radially between the center body 50 and the inner shroud 52 to impart axial swirl to the working fluid as it passes across the vanes 64 and through the axial flow region 58. In particular embodiments, the center body 50 may be breech loaded through the end cover assembly 30 and/or through the inner shroud 52 and the outer shroud 52, thus allowing for removal and/or replacement of the center body 50 from the fuel nozzle 34. In this manner, the costs and outage time required to replace/repair the center body 50 of a fuel nozzle 34 may be significantly reduced. The center body 50 may diverge radially outward and/or converge radially inward, and the center body 50 may be any shape, for example, it does not have to be circular, cylindrical or symmetric.

As shown in FIG. 5, the inner shroud 52 circumferentially surrounds at least a portion of the center body 50 and forms an inner annular passage 56 between the center body and the inner shroud 52. The inner annular passage 56 provides the axial flow region 58 between the center body 50 and the inner shroud 52. The inner shroud 52 directs the working fluid through the axial flow region 58. The inner shroud 52 may include one or more fluid circuits 66, and the one or fluid circuits 66 may be configured to flow a liquid or gaseous fuel. The inner shroud 52 has a downstream surface 68. In particular embodiments, the downstream surface 68 may terminate at a point. For example, a sharp or knife-edge may be formed along the downstream surface 68 at the termination point. Alternately or in addition, the inner shroud 52 may converge toward the center body 50 to narrow the width of the inner annular passage 56. In this manner, as the working fluid passes through the axial flow region 58, the converging inner shroud 52 may accelerate the working fluid and direct the working fluid in an axial direction along the center body 50. Similarly, the inner shroud 52 may diverge from the outer shroud 54. In this manner, as the working fluid enters the outer annular passage 58 into the radial flow region 62, the diverging inner shroud 52 may provide a barrier to segregate the radial flow region 62 from the axial flow region 58 and may direct the working fluid axially downstream from the inner shroud 52 downstream surface 68.

Figure 6:
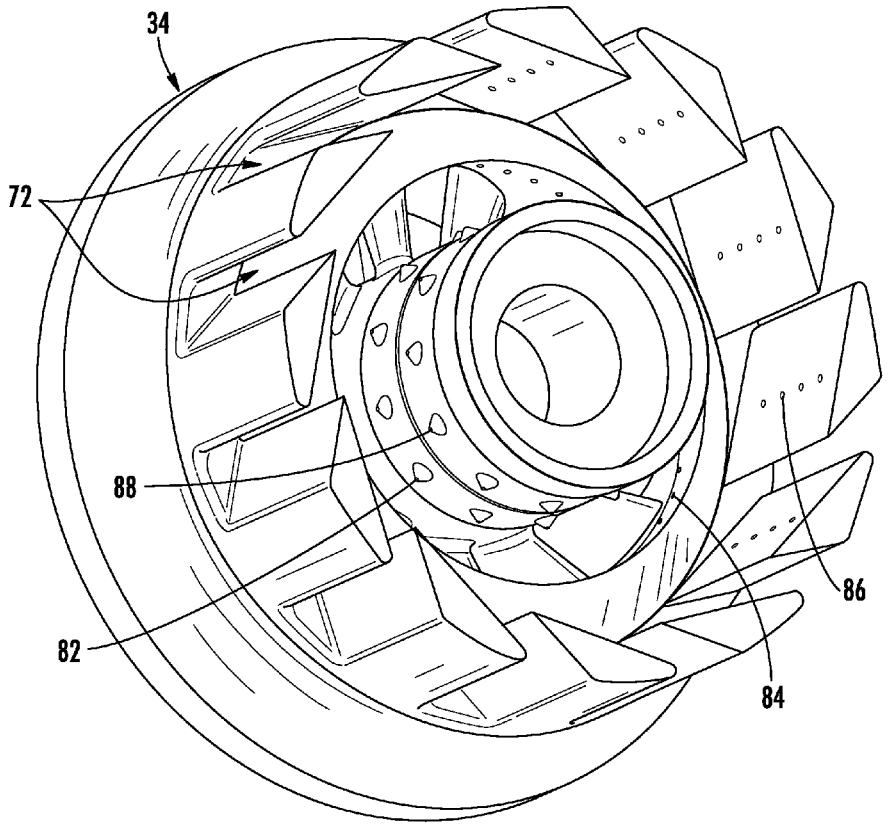
FIG. 6 is a perspective view of a portion of the nozzle shown in FIG. 4.

The outer shroud 54 circumferentially surrounds at least a portion of the inner shroud 52 and/or center body 50 to confine the working fluid and/or fuel flowing through the fuel nozzle 34. As shown most clearly in FIG. 5, the outer shroud 54 may include one or more fluid circuits 70, and the one or more fluid circuits 70 may be configured to flow a liquid or gaseous fuel. The outer shroud 54 may be a separate structure or it may be integrally connected to the inner shroud 52. The outer shroud 54 and/or the inner shroud 52 may be rigidly connected to the combustor, for example, by a strut 74 or by any other means for supporting a structure. In this manner, the center body 50 may be inserted through the inner and outer shrouds 52, 54 in a breech loading fashion. In addition, the outer shroud 54 may include structure for radially swirling the working fluid and/or fuel flowing through the fuel nozzle 34. For example, as shown in FIG. 6, the outer shroud 54 may include a plurality of angled passages 72 through the outer shroud. The angled passages 72 may impart radial swirl to the working fluid and/or the liquid or gaseous fuel in order to promote mixing of the working fluid and the liquid or gaseous fuel within the radial flow region 62. In addition, the angled passages 72 may impart radial swirl to the working fluid and/or fuel flowing through the fuel nozzle 34 in the same direction or in opposition directions from the swirl provided by the center body 50 radially extending vanes 64 within the axial flow region 58, depending on the particular embodiment. The outer shroud 54 may converge radially inward downstream of the inner shroud downstream surface 68. In this manner, the pre-mixed working fluid and fuel may become compressed and/or accelerate as it leaves the fuel nozzle 34 before expanding into the combustion chamber 34 for burning, thus reducing the risk of flame holding or flashback at the exit plane of the fuel nozzle 34.

Figure 7:
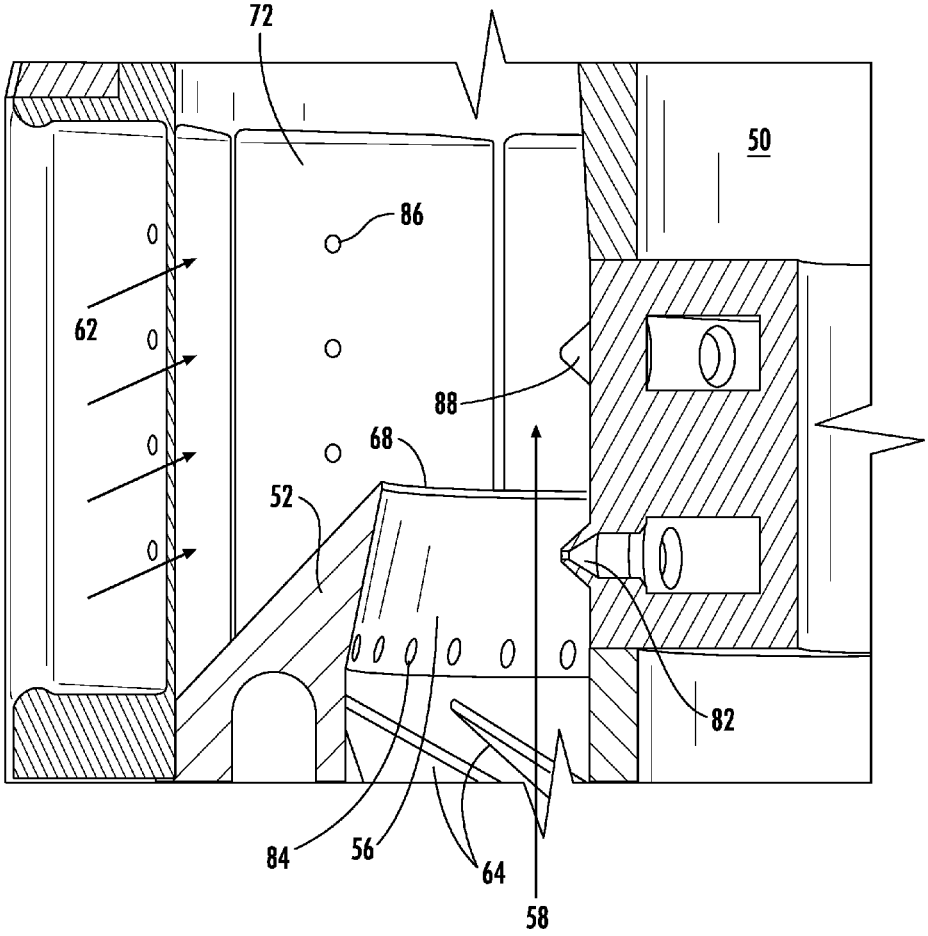
FIG. 7 is an enlarged cross-section of a portion of the nozzle shown in FIG. 4.

FIG. 7 provides an enlarged cross-section of a portion of the fuel nozzle 34 shown in FIG. 4. As shown in FIG. 6 and FIG. 7, the fuel nozzle 34 may include a plurality of fuel ports in one or more of the center body 50, inner shroud 52, and outer shroud 54. Each fuel port may be angled radially, axially, and/or azimuthally to project and/or impart swirl to the fuel flowing through the fuel ports and into the fuel nozzle 34. Each of the fuel ports may be configured to flow gaseous and/or liquid fuels. In the particular embodiment, as shown in FIG. 7, a first plurality of fuel ports 82 may extend substantially radially outward through the center body 50 and may operate independently or in conjunction with one or more of the plurality of fuel ports. The first plurality of fuel ports 82 is upstream from the downstream surface 68 of the inner shroud 52 and may be configured to provide a gaseous or a liquid fuel. In this manner, when the first plurality of fuel ports 82 injects a liquid fuel radially outward from the center body 50 and into the inner annular passage 56, at least a portion of the liquid fuel will be vaporized and mixed with the working fluid as it passes through the axial flow region 58. However, the remaining portion of liquid fuel will generally strike the inner shroud 52. As a result, the working fluid in the axial flow region 58 will cause the remaining liquid fuel to pre-film on the inner shroud 52 as it transfers the pre-filmed liquid fuel across the converging inner shroud downstream surface 68. As the pre-filmed fluid separates from the knife-edged downstream surface 68, it may be sheared into droplets and distributed into the counter rotating air streams created within the axial flow region 58 and the radial flow region 62. As a result, a very fine and consistent liquid fuel spray is provided for improved fuel and working fluid mixing prior to combustion, thus reducing the amount of water or other additives necessary to control combustion emissions and further improving the overall efficiency of the gas turbine while running on a liquid fuel. In addition, as the liquid fuel is injected radially outward from the center body 50, the inner shroud 52 will at least partially segregate the liquid fuel and working fluid mixture in the axial flow region 58 from the radial flow region 62, thus allowing greater control over the inner and outer fuel mix split during operation of the gas turbine.

A second plurality of fuel ports 84 may direct fuel radially inward from the inner shroud and into the axial flow region 58 and may operate independently or in conjunction with one or more of the plurality of fuel ports. The second plurality of fuel ports 84 may be configured to flow a gaseous or liquid fuel. When a gaseous fuel is injected from the second plurality of fuel ports 84 and into the axial flow region 58, the gaseous fuel will at least partially mix with the working fluid and will be transferred across the inner shroud downstream surface 68. In certain embodiments, the inner shroud downstream surface 68 may converge and terminate at a point. As a result, the inner shroud downstream surface 68 may accelerate and direct the working fluid and gaseous fuel mixture generally axially along the center body 50, thus at least partially segregating the axial flow region 58 from the radial flow region 62, thereby providing greater control over inner and outer fuel mixing split during operation of the gas turbine.

A third plurality of fuel ports 86 may extend radially inward from the outer shroud 54 and may operate independently or in conjunction with one or more of the plurality of fuel ports. In some embodiments, the third plurality of fuel ports 86 may be located on the plurality of angled passages 72. The third plurality of fuel ports 86 may be configured to flow a gaseous or liquid fuel. In this manner, as the gaseous fuel is in injected from the third plurality of fuel ports 86 and into the radial flow region 62, the gaseous fuel will at least partially mix with the working fluid for combustion in the combustion chamber 40. In addition, the working fluid and fuel pre-mixed in the radial flow region 62 may be at least partially segregated from the axial flow region, thus allowing greater control over inner and outer fuel mixing split during operation of the gas turbine.

A fourth plurality of fuel ports 88, downstream from the downstream surface 68 of the inner shroud 52, may extend substantially radially outward through the center body 50 and may be configured to flow a liquid or gaseous fuel. In certain embodiments, a liquid fuel may be injected from the fourth plurality of fuel ports 88 and into the radial flow region 62 of the fuel nozzle 34. In this manner, at least a portion of the liquid fuel will be vaporized and mixed with the working fluid as the liquid fuel and working fluid pass into the radial flow region 62. However, the remaining portion of liquid fuel may be air blasted by the intense shear generated by the counter swirling working fluid from both the axial and radial flow regions 58 & 62 respectfully. As the liquid fuel encounters this shear, the liquid fuel may be further vaporized, thus resulting in a fine and consistent mist of liquid fuel. As a result, the vaporized liquid fuel will more easily pre-mix with the working fluid prior to combustion.

The various embodiments shown and described with respect to FIGS. 1-7 may also provide a method for supplying fuel to the combustor 10. The method may include flowing a working fluid through an inner annular passage 56 between a center body 50 and an inner shroud 52, injecting a first fuel from the center body 50 against the inner shroud 52, and flowing at least a portion of the working fluid through an outer annular passage 60 that circumferentially surrounds at least a portion of the inner shroud 52. In particular embodiments, the method may further include injecting a liquid fuel from the center body 50 radially outward into the inner annular passage 56 for pre-mixing the working fluid with the liquid fuel. In addition, the method may further include pre-filming the liquid fuel along the inner shroud 52, wherein the inner shroud converges radially inward towards the center body 50 and the downstream surface 68 terminates at a point. For example, the downstream surface 68 may form a knife-edge. The method may further include swirling the working fluid flowing through the inner annular passage 56 in a first direction and swirling the working fluid flowing through the outer annular passage 60 in a second direction, wherein the first direction is opposite from the second direction.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor fuel nozzle, comprising:

a. a center body;

b. an inner shroud that circumferentially surrounds at least a portion of the center body, wherein the inner shroud has a downstream surface;

c. an inner annular passage between the center body and the inner shroud;

d. an outer annular passage that circumferentially surrounds at least a portion of the inner shroud; and e. a first plurality of fuel ports that extend substantially radially outward through the center body, wherein the first plurality of fuel ports is upstream from the downstream surface of the inner shroud, wherein the first plurality of fuel ports is configured to inject fuel against the inner shroud; and f. a second plurality of fuel ports that extend substantially radially outward through the center body, wherein the second plurality of fuel ports is downstream from the downstream surface of the inner shroud.

2. The combustor fuel nozzle as in claim 1, wherein the downstream surface of the inner shroud terminates at a point.

3. The combustor fuel nozzle as in claim 1, wherein the inner shroud converges toward the center body to narrow the inner annular passage.

4. The combustor fuel nozzle as in claim 1, further comprising a plurality of vanes that extend radially between the center body and the inner shroud.

5. The combustor fuel nozzle as in claim 1, further comprising a third plurality of fuel ports that extend radially inward from the inner shroud.

6. The combustor fuel nozzle as in claim 1, further comprising an outer shroud that circumferentially surrounds at least a portion of the inner shroud.

7. The combustor fuel nozzle as in claim 6, further comprising a fourth plurality of fuel ports that extend radially inward from the outer shroud.

8. The combustor fuel nozzle as in claim 6, further comprising a plurality of angled passages through the outer shroud.

9. A combustor fuel nozzle, comprising:

a. a center body;

b. an inner shroud that circumferentially surrounds at least a portion of the center body, wherein the inner shroud has a downstream surface;

c. an inner annular passage between the center body and the inner shroud;

d. an outer annular passage that circumferentially surrounds at least a portion of the inner shroud;

e. a first plurality of fuel ports that extend substantially radially outward through the center body, wherein the first plurality of fuel ports is upstream from the downstream surface of the inner shroud, wherein the first plurality of fuel ports is configured to inject fuel against the inner shroud;

f. a plurality of fuel ports that extend radially inward from the inner shroud; and g. a plurality of fuel ports that extend substantially radially outward through the center body, wherein the plurality of fuel ports is downstream from the downstream surface of the inner shroud.

10. The combustor fuel nozzle as in claim 9, wherein the downstream surface of the inner shroud terminates at a point.

11. The combustor fuel nozzle as in claim 9, wherein the inner shroud converges toward the center body to narrow a width of the inner annular passage.

12. The combustor fuel nozzle as in claim 9, further comprising a plurality of vanes that extend radially between the center body and the inner shroud.

13. The combustor of claim 9, wherein the center body is breech loaded through the inner shroud.

14. The combustor fuel nozzle as in claim 9, further comprising an outer shroud that circumferentially surrounds at least a portion of the inner shroud.

15. The combustor fuel nozzle as in claim 13, further comprising a fourth plurality of fuel ports that extend radially inward from the outer shroud.

16. The combustor fuel nozzle as in claim 13, further comprising a plurality of angled passages through the outer shroud.

17. A method for supplying fuel to a combustor fuel nozzle, comprising:

a. flowing a working fluid through an inner annular passage between a center body and an inner shroud;

b. injecting a portion of a first fuel against the inner shroud from a first plurality of fuel ports that extend substantially radially outward through the center body, wherein the first plurality of fuel ports is upstream from a downstream surface of the inner shroud;

c. injecting a portion of the first fuel through a second plurality of fuel ports that extend substantially radially outward through the center body, wherein the second plurality of second fuel ports is downstream from the downstream surface of the inner shroud; and d. flowing at least a portion of the working fluid through an outer annular passage that circumferentially surrounds at least a portion of the inner shroud.

18. The method as in claim 16, further comprising prefilming the first fuel along the inner shroud, wherein the first fuel is a liquid fuel and the inner shroud includes a downstream surface that terminates at a point.

* * * * *